US007892043B1

(12) United States Patent
Orand et al.

(10) Patent No.: US 7,892,043 B1
(45) Date of Patent: Feb. 22, 2011

(54) KEY ASSEMBLIES TO MECHANICALLY KEY PLUGGABLE-MODULE SOCKETS

(75) Inventors: Austin Jacob Orand, Austin, TX (US); Darryl David Daniel, Austin, TX (US); Glen Eric Biron, Cedar Park, TX (US)

(73) Assignee: Fisher-Rosemount Systems, Inc., Austin, TX (US)

( * ) Notice: Subject to any disclaimer, the term of this patent is extended or adjusted under 35 U.S.C. 154(b) by 0 days.

(21) Appl. No.: 12/563,743

(22) Filed: Sep. 21, 2009

(51) Int. Cl.
*H01R 13/64* (2006.01)

(52) U.S. Cl. ..... 439/681

(58) Field of Classification Search ..... 439/680, 439/681, 674

See application file for complete search history.

(56) References Cited

U.S. PATENT DOCUMENTS 3,023,394 A * 2/1962 Hubbell ..... 439/337

* cited by examiner

*Primary Examiner*—Javaid Nasri
(74) *Attorney, Agent, or Firm*—Hanley, Flight, & Zimmerman, LLC

(57) ABSTRACT

Key assemblies to mechanically key pluggable-module sockets are described. A disclosed example key assembly includes a key having a shaft, a first radial protrusion extending from the shaft and an annular guide surface on the shaft; and a key base having a plurality of fingers defining a plurality of radial slots and an opening to receive at least a portion of the shaft, wherein at least one of the fingers is to engage the annular guide surface to enable the key to rotate to a set position, and wherein the first radial protrusion is to engage one of the slots to rotationally hold the key in a set position when the at least one of the fingers forced out of engagement with the annular guide surface.

25 Claims, 11 Drawing Sheets

FIG. 5C
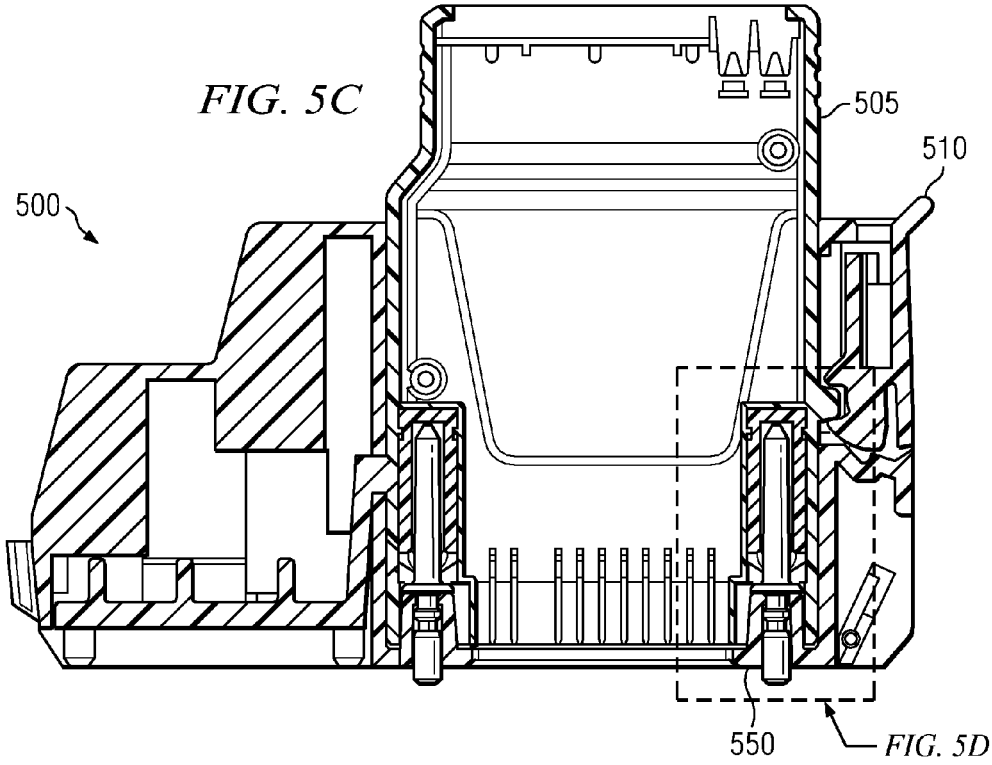
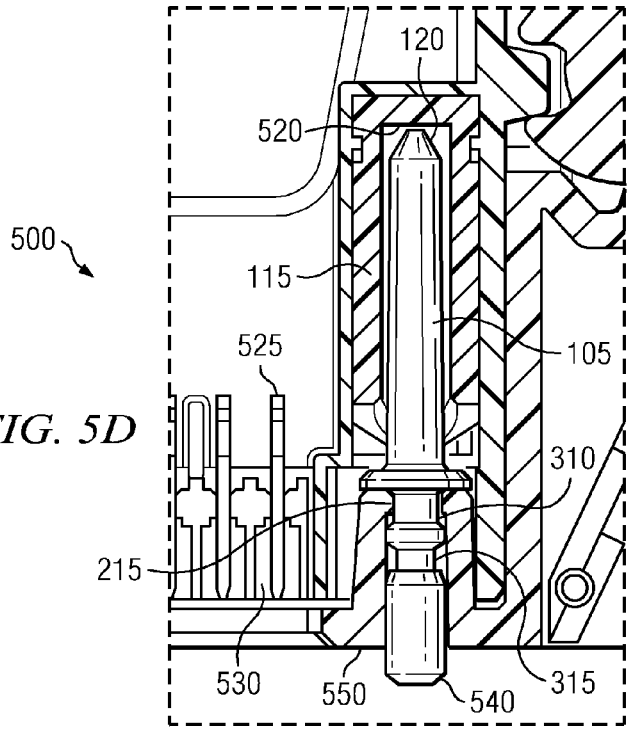
FIG. 5D

KEY ASSEMBLIES TO MECHANICALLY KEY PLUGGABLE-MODULE SOCKETS

FIELD OF DISCLOSURE

This disclosure relates generally to pluggable-module sockets and, more particularly, to key assemblies to mechanically key pluggable-module sockets.

BACKGROUND

Some communication, power distribution, media distribution, process control, computing, etc. systems include a bus, base, rack and/or frame to which a plurality of pluggable, insertable, installable and/or field replaceable modules can be electrically and/or communicatively coupled. An example base, rack and/or frame includes a plurality of sockets, connectors and/or slots into which different modules can be inserted and/or plugged. Such sockets and/or slots can, for example, facilitate electrical and/or optical coupling of their respective pluggable module to one or more communication and/or distribution media (e.g., a wire and/or a cable) and/or to one or more devices coupled to the communication media.

SUMMARY

Key assemblies to mechanically key pluggable-module sockets are disclosed. A disclosed example key assembly includes a key having a shaft, a first radial protrusion extending from the shaft and an annular guide surface on the shaft; and a key base having a plurality of fingers defining a plurality of radial slots and an opening to receive at least a portion of the shaft, wherein at least one of the fingers is to engage the annular guide surface to enable the key to rotate to a set position, and wherein the first radial protrusion is to engage one of the slots to rotationally hold the key in a set position when the at least one of the fingers forced out of engagement with the annular guide surface.

A disclosed example assembly includes a first module having a key and a key base, and a second module having a first key receptacle to set a rotational position of the key corresponding to a rotational orientation of the first key receptacle when the second module is inserted into the first module, the rotational position of the key to remain set when the second module is removed from the first module and to prevent a third module having a second receptacle having a different rotational orientation from being inserted in the first module.

A disclosed example key receptacle to mechanically set a position of a key includes a body shaped to maintain a rotational orientation of the key receptacle, a cam surface defined on an end of the body to rotate the key during an engagement of the key receptacle and the key, and a longitudinal slot corresponding to the rotational orientation of the key receptacle to slidably engage a protrusion of the key and to hold the rotational position of the key while the rotational position of the key is set.

BRIEF DESCRIPTION OF THE DRAWINGS

FIGS. 5A-5D illustrate an example keying of a pluggable-module socket with the example key assembly of FIGS. 1A-1F, 2A-2C, 3, 4A and 4B.

Figure 1A:
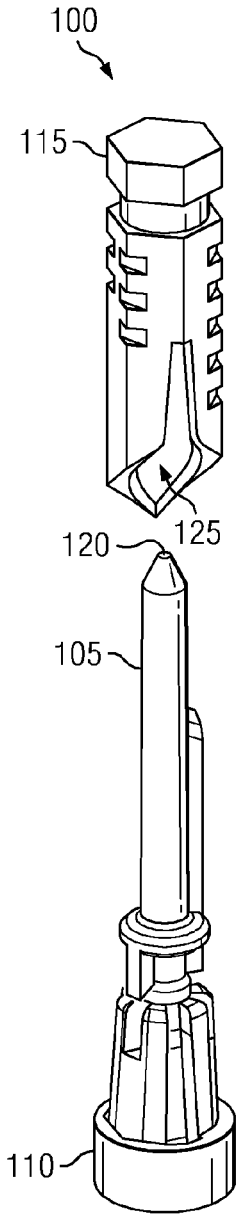
FIGS. 1A-1F illustrate an example key assembly.

Certain examples are shown in the above-identified figures and described in detail below. In describing these examples, like or identical reference numbers may be used to identify identical, common and/or similar elements. The figures are not necessarily to scale and certain features and certain views of the figures may be shown exaggerated in scale or in schematic for clarity and/or conciseness. Moreover, while certain preferred embodiments are disclosed herein, other embodiments may be utilized and structural changes may be made without departing from the scope of the invention.

DETAILED DESCRIPTION

Because a pluggable module may correspond to and/or implement functionality specific to a particular type of communication medium, and/or for a specific device coupled to the communication medium, when a pluggable module is replaced it normally needs to be replaced with an identical and/or compatible replacement. Existing methods rely on a person to correctly identify and insert an appropriate replacement pluggable module to ensure that the system continues to operate as intended. However, such methods are prone to human error and may not provide adequate protection against improperly chosen and/or installed pluggable modules. Such errors may, for example, cause a system to cease operating as intended and/or lead to an impaired operating condition.

To overcome at least these deficiencies, the example key assemblies described herein mechanically key an un-keyed pluggable-module socket and/or slot when a pluggable module is first inserted into the un-keyed socket and/or slot. If this pluggable module is removed, only a pluggable module having matching, corresponding and/or compatible key receptacle rotational orientation(s) can be inserted into the keyed socket and/or slot. A pluggable module not having matching, corresponding and/or compatible key receptacle rotational orientation(s) is substantially prevented from being inserted into the keyed socket and/or slot. Because insertion of a non-compatible pluggable module is resisted and/or substantially prevented, installation of an identical and/or compatible pluggable module is ensured. The rotational orientation of the key receptacle(s) of the pluggable module may be determined, set and/or selected during manufacturing to ensure that the pluggable module cannot inadvertently be incorrectly keyed during installation. To reduce the chances of unintentional re-keying of a pluggable-module socket, the example key(s) of the socket and/or slot may require intentional and/or physical reset by a person before the socket and/or slot can be re-keyed. For example, the key(s) can be reset by removing the pluggable module and pushing and/or applying a force to a bottom side of the pin, which laterally positions the key such that the key is again free to rotate. Additionally or alternatively, with the pluggable module removed the pin can be pulled from within the pluggable-module socket. In some examples, the key assembly is designed and/or manufacture to prevent the key from being readily, easily and/or completely removed from the pluggable-module socket. Pluggable modules may be assigned keys in accordance with any number and/or type of rules(s), pattern(s), logic, and/or criterion(ia). For example, a first key assembly can be used to distinguish a first pluggable module characteristic, such as normal use, explosion proof and/or safety related, with additional key assemblies used to distinguish additional, other and/or secondary pluggable module characteristics.

It should be readily apparent to persons of ordinary skill in the art that the example key assemblies described herein are applicable to any number and/or type(s) of system(s), device(s), and/or platform(s) having any number and/or type(s) of socket(s), receiver(s), receptacle(s) and/or slot(s) into which any number and/or type(s) of pluggable module(s) can be inserted. The particular examples system(s), device(s) and/or platform(s) described herein that may be physically keyed as described herein are merely illustrative examples, and the scope of coverage of this patent is not limited thereto. On the contrary, this patent covers all methods, apparatus, systems, and articles of manufacture fairly falling within the scope of the appended claims either literally or under the doctrine of equivalents.

FIGS. 1A-1F illustrate an example key assembly 100 including a key 105, a key base 110 and a key receptacle 115. FIGS. 1A-1F illustrate an example operation of the example key assembly 100 as the example key receptacle 115 engages the example key 105 to set the position of the key 105 relative to the key base 110. As described in detail below and as shown in FIGS. 5A-5D and 7A-7B, the example key assembly 100 of FIGS. 1A-1F can be used to mechanically key a pluggable-module socket 510, 710 such that only a pluggable module 505, 705 having corresponding rotationally oriented key receptacles 115 can be inserted into the keyed pluggable-module socket 510, 710.

Figure 1B:
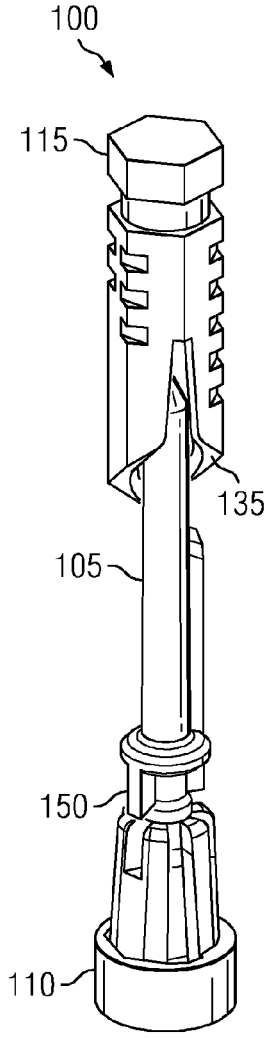
Figure 1C:
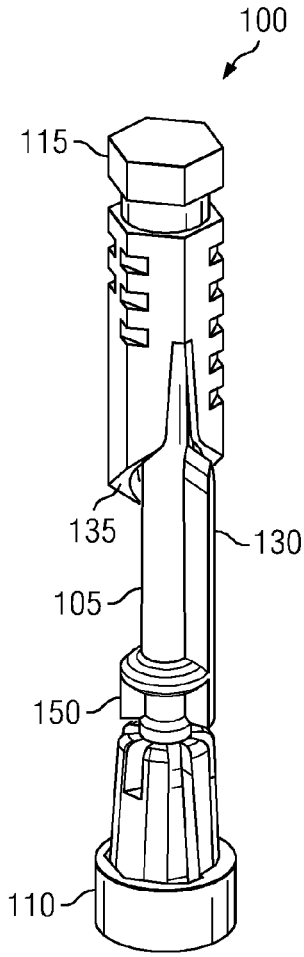
Figure 1D:
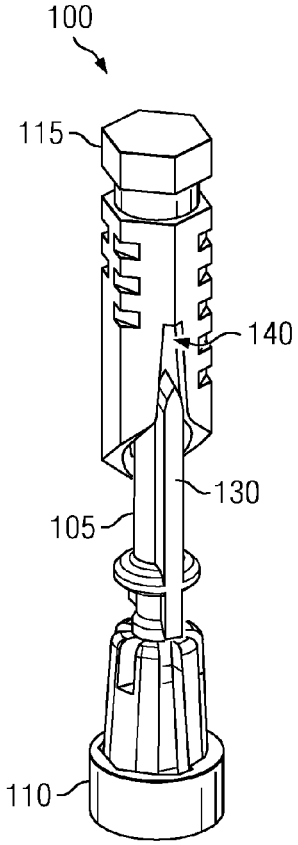

In FIG. 1A, the example key receptacle 115 has not yet started to engage the example key 105. As the key receptacle 115 begins to engage the key 105, as shown in FIG. 1B, a tapered end portion 120 of the example key 105 begins to advance into an open end 125 of the key receptacle 115. As illustrated in FIG. 1C, as the example key 105 continues to advance into the example key receptacle 115, a rounded, angled, contoured and/or tapered end 325 (FIG. 3A) of a wing and/or protrusion 130 of the key 105, which in the example of FIGS. 1A-1F is a elongated radial protrusion parallel the longitudinal axis of the key 105, engages a sloped, angled, ramped, rounded, contoured and/or cam surface and/or edge 135 of the key receptacle 115. The engagement of the protrusion 130 with the cam surface 135 causes the key 105 to rotate, as shown in the sequence of FIGS. 1B-1D. To improve mechanical alignment and/or mechanical stability, the position of the example protrusion 130 on the key 105 may be selected so that the tapered end portion 120 of the key 105 begins advancing into the example key receptacle 115 before the end 325 of the protrusion 130 first engages the cam surface and/or edge 135, as shown in FIGS. 1B and 1C.

Figure 1E:
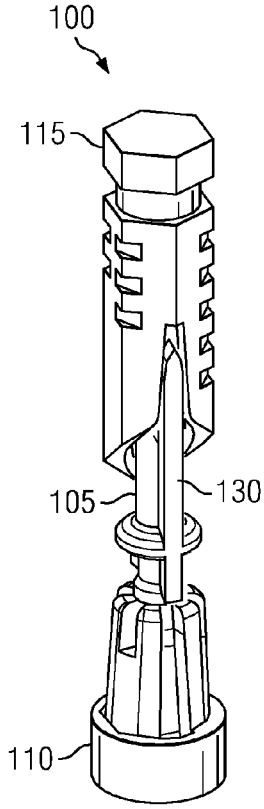
Figure 1F:
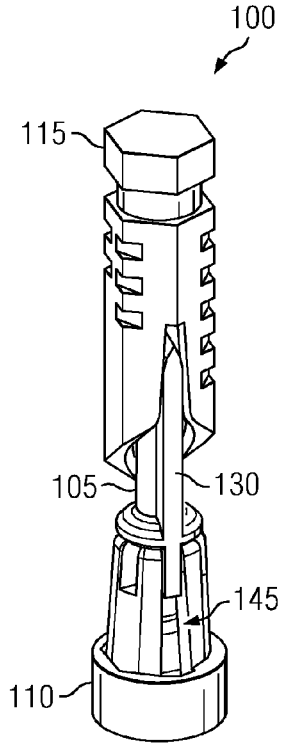

As shown in FIGS. 1D and 1E, when the example protrusion 130 has rotated into alignment with and/or engages a slot 140 in the example key receptacle 115, the rotation of the example key 105 stops and the key 105 continues advancing into the key receptacle 115 in substantial rotational alignment with the key receptacle 115. When the tapered end portion 120 of the example key 105 reaches an interior surface 520 (FIG. 5) of the example key receptacle 115, continued movement of the key receptacle 115 and/or the key 105 toward each other applies a longitudinal force to the key 105 in the direction of the example key base 110. The longitudinal force applied to the key 105 by the interior surface 520 of the key receptacle 115 moves the key 105 longitudinally into the key base 110 to engage the example protrusion 130 with one of a plurality of radial slots of the key base 110, one of which is designated at reference numeral 145. The example key base 110 of FIGS. 1A-1F can engage one or more annular guide surfaces of the key 105 (e.g., groves, ridges, rings, stops, tapers, etc.) to either hold and/or position the key 105 in a first longitudinal position wherein the key 105 can rotate, as shown in FIGS. 1C and 1D, or to hold and/or position the key 105 in a second longitudinal position wherein the rotational position of the key 105 is held fixed. In some examples, which are described below in connection with FIGS. 2A-2C and FIG. 3A, when the longitudinal force is applied one or more fingers 205 and/or snap heads 215 of the key base 110 (FIG. 2) are elastically deformed, displaced and/or bent to disengage a lower grove (i.e., a second annular guide surface) 315 (FIG. 3A) of the key 105 and to engage an upper groove (i.e., a first annular guide surface) 310 (FIG. 3A) of the key 105 to hold the protrusion 130 within the radial slot 145 corresponding to the rotational orientation of the key receptacle 115, thereby setting and/or fixing the keyed rotational position of the key 105. As shown in FIGS. 1A-1E, until the force is applied to the key 105, the snap head(s) 215 engages a lower groove (i.e., a second annular guide surface) 315 (FIG. 3A) of the key 105 that prevents the protrusion 130 from engaging any of the radial slots 145, thereby allowing the key 105 to freely rotate as the protrusion 130 engages the cam surface and/or edge 135. Any or all of the example fingers 205 and/or the example snap heads 215 can flex, be elastically deformed, displaced and/or bent.

Figure 9:
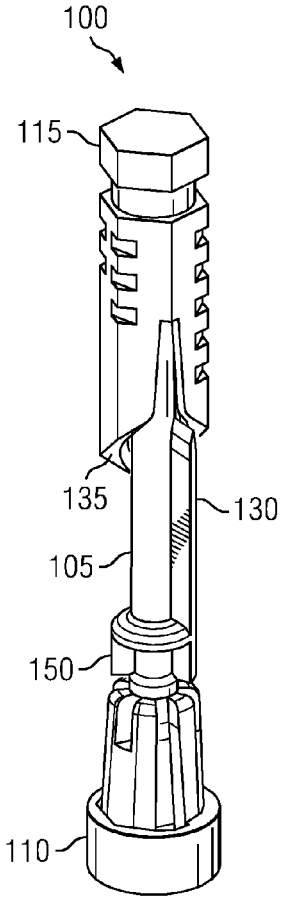
FIGS. 9-11 illustrates other example manners of implementing the example key assembly 100 of FIGS. 1A-1F.
Figure 10:
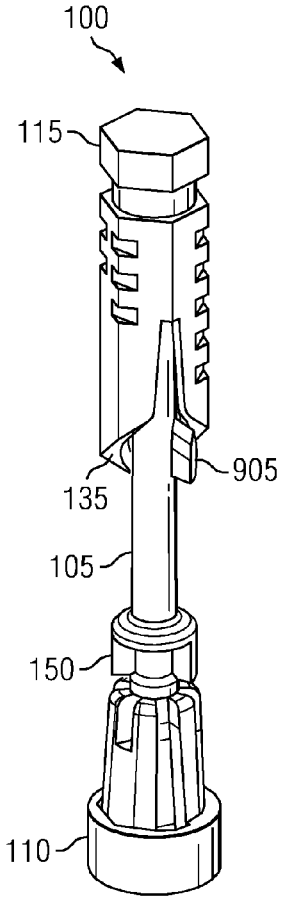

As shown in FIGS. 1A-1F, the example key 105 may include one or more additional radial protrusions, one of which is designated at reference numeral 150, which engage with other radial slots 145 of the key base 110 as the rotational position of the key 105 is set. Additionally or alternatively, as shown in FIG. 9, the protrusion 130 need not extend such that it can engage one of the radial slots 145 when the rotation position of the key 105 is set. Instead, the radial protrusion 150, which may or may not be radially aligned with the protrusion 130, can be used to rotationally hold the key 105 when the position of the key 105 is set. Further still, as shown in FIG. 10, the protrusion 130 may be relatively short radial protrusion and/or wing 905 on the key 105 rather than the example elongated protrusion shown in FIGS. 1A-1F.

Figure 2A:
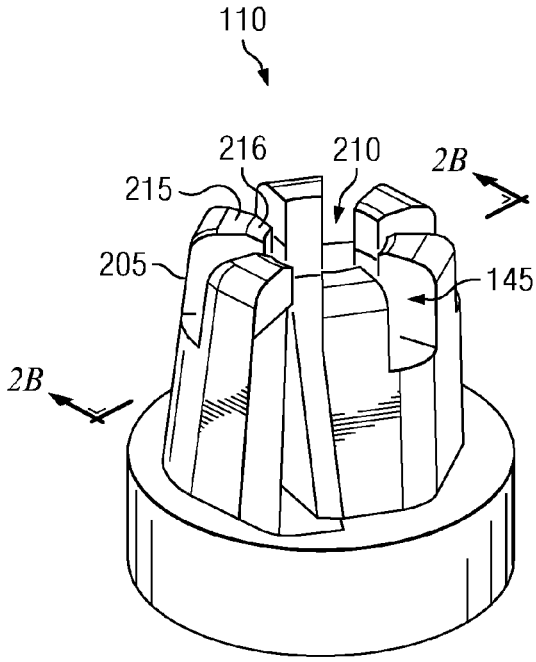
FIGS. 2A-2C illustrate an example manner of implementing the example key base of FIGS. 1A-1F.
Figure 2B:
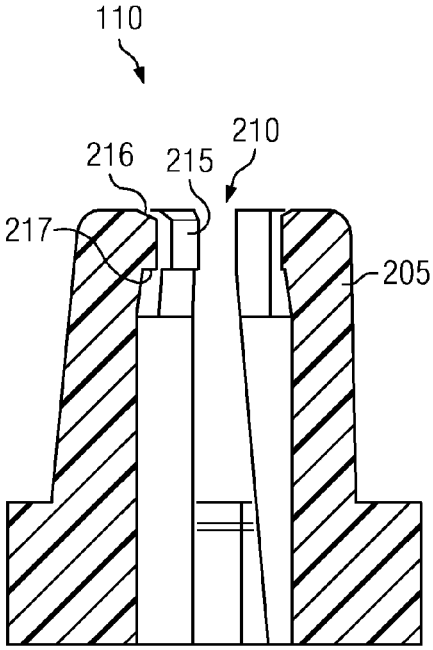
Figure 2C:
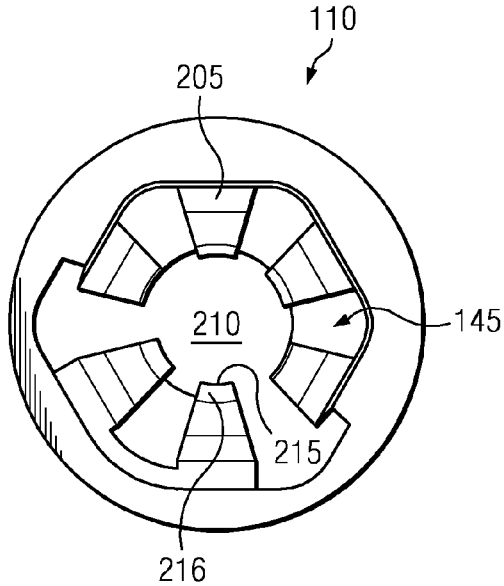
Figure 11:
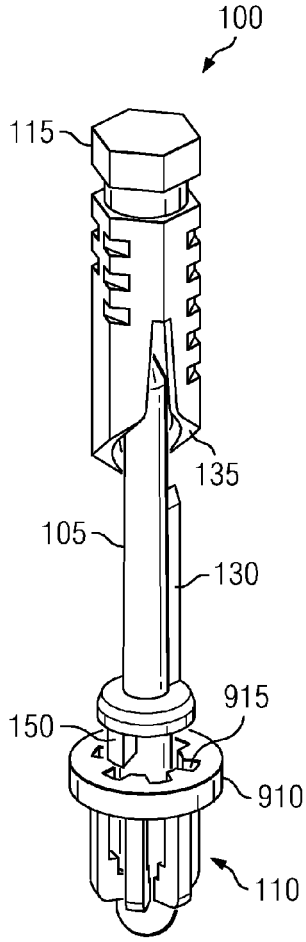

As shown in FIG. 11, the key base 110 may be oriented differently with respect to the example key 105. In the illustrated example of FIG. 11, the key base 110 is inverted relative to the examples of FIGS. 1A-1F, 9 and 10. The example key base 110 of FIG. 11 includes a base 910 having radial slots, one which is designated at reference numeral 915, corresponding to the radial slots 145 formed by the fingers 205 (FIGS. 2A-2C). The protrusion(s) 130 and/or 150 can engage the slot(s) 915 when the rotational position of the key 105 is set.

As described below in connection with FIGS. 4A-4B and 8, the rotational orientation of the example key receptacle 115 does not change as the example key 105 engages the key receptacle 115. As shown in FIGS. 1A-1F, the key 105 becomes rotationally aligned with the orientation of the key receptacle 115 as the key 105 and key receptacle 115 engage. If the example key receptacle 115 were removed and a different key receptacle having a different rotational orientation were engaged with the keyed key 105 of FIG. 1F, the radial protrusion 130 would not rotationally align with the slot of the differently oriented key receptacle, thereby preventing the differently oriented key receptacle from fully engaging the key 105. Thus, if the example key 105 and the example key base 110 were implemented in a pluggable-module socket (e.g., the socket 510 of FIGS. 5A-5D), and the key receptacle 115 implemented in a particular type of pluggable module (e.g., the module 505 of FIGS. 5A-5D), when that particular type of pluggable module is first inserted in the un-keyed pluggable-module socket, the socket becomes physically keyed to that particular type of pluggable module. If a person subsequently tries to insert a pluggable module having a differently oriented key receptacle 115 into the keyed socket, the person will be substantially prevented from fully inserting that differently keyed pluggable module into the keyed socket.

In the illustrated example of FIGS. 1A-1F, the key receptacle 115 is hexagonally shaped, with each side and/or rotational position of the key receptacle 115 corresponding to a possible rotational orientation of the key receptacle 115. The example key base 110 is aligned relative to the key receptacle 115 such that the example slots 145 of the key base 110 are rotationally aligned with the possible rotational orientations of the slot 140. As shown in FIGS. 1A-1F, 4A-B and 8, the key receptacle 115 has a different pattern of orientation slots 405 on each side of the key receptacle 115. When a key receptacle 115 is installed in a pluggable module at, for example, manufacturing time, the rotational orientation of the key receptacle 115 is selected such that a pattern of orientation protrusions within the pluggable module corresponds to the pattern of orientation slots 405 of the installed key receptacle 115. While the example key receptacle 115 described herein has six sides corresponding to six possible orientations, the key receptacle 115 may alternatively have any number of sides, may be configured in any other geometry, and/or may have any other number of possible rotational orientations. While the example key receptacles 115 illustrated herein have a body shaped to hold the key receptacles 115 in different rotation orientations, any number and/or type(s) other structure(s) and/or shape(s) may be used to select and/or hold the rotational orientation of a key receptacle 115. Other example key receptacle shapes include, but are not limited to, a cylindrically-shaped key receptacle 115 having radial protrusions, a star-shaped key receptacle 115, etc.

FIG. 2A illustrates an example manner of implementing the example key base 110 of FIGS. 1A-1F. FIG. 2B is a side cross-sectional view of the example key base 110 of FIG. 2A taken along line 2B-2B. FIG. 2C is a top view of the example key base 110 of FIG. 2A. The example key base 110 of FIGS. 2A-2C includes fingers, one of which is designated at reference numeral 205, which form a cylindrical passageway 210 through the key base 110 for the key 105. Gaps and/or spaces between the fingers 205 form the example radial slots 145 with which the example radial protrusion 130 may be engaged.

In the illustrated example of FIGS. 2A-2C, a portion of two of the example fingers 205 are flexible, bendable and/or elastically deformable, and have a snap head 215 that extends further into the example cylindrical passageway 210 than the other fingers 205. Because they are flexible, these two fingers 205 can move inward and outward to selectively engage one or more annular guide surfaces (e.g., the example grooves 310, 315 of FIG. 3A, an example ring 350 of FIG. 3B, etc.) of the example the example grooves 310, 315 of the example key 105. When the snap heads 215 of the fingers 205 are engaged in the lower groove 315, the protrusion 130 is prevented from engaging any of the radial slots 145 and the key 105 can freely rotate. When the snap heads 215 are engaged in the upper groove 310, the protrusion 130 is engaged in one of the radial slots 145 and the key 105 is prevented from rotating or rotationally held. In some examples, the snap heads 215 extend 0.35 millimeters (mm) more than the other fingers 205 into the cylindrical space 210 with top edges 216 of the snap heads 215 angled at 30 degrees from horizontal to facilitate disengagement of the snap head 215 from the lower groove 315 and engagement with the upper groove 310. Bottom edges 217 of the snap heads 215 are flat to resist disengagement with the upper groove 310, and to prevent the key 105 from inadvertently coming out of the key base 110 completely. In general, the flexible fingers 205 are configured to be stiff enough to prevent premature setting of the key 105 prior to the radial protrusion 130 becoming rotationally aligned with the slot 140, while not requiring the application of an excessive position setting force that could cause the key 105 to break. In some examples, the key base 110 is formed and/or molded from a flexible material, such as a PPE+PS (e.g., Xyron 644X), which has a relatively low coefficient of friction, and is finished to have a polished finish and to be substantially free of flash. In the examples described herein, the amount of longitudinal force required to disengage the snap heads 215 from the lower groove 315 and engage them in the upper groove 310 is less than 2 lbs to allow a user to easily insert a pluggable module to key a pluggable-module socket.

While the example key base 110 illustrated in FIGS. 2A-2C implements the example snap heads 215 to hold the key 105 in the two positions corresponding to the two example grooves 310 and 315, additionally or alternatively, the key 105 and/or key base 110 may be spring loaded so that the key 105 can be held in these two positions. Another example manner of implementing the key base 110 is illustrated in FIG. 11 and was described above in connection with FIGS. 1A-1F.

Figure 3A:
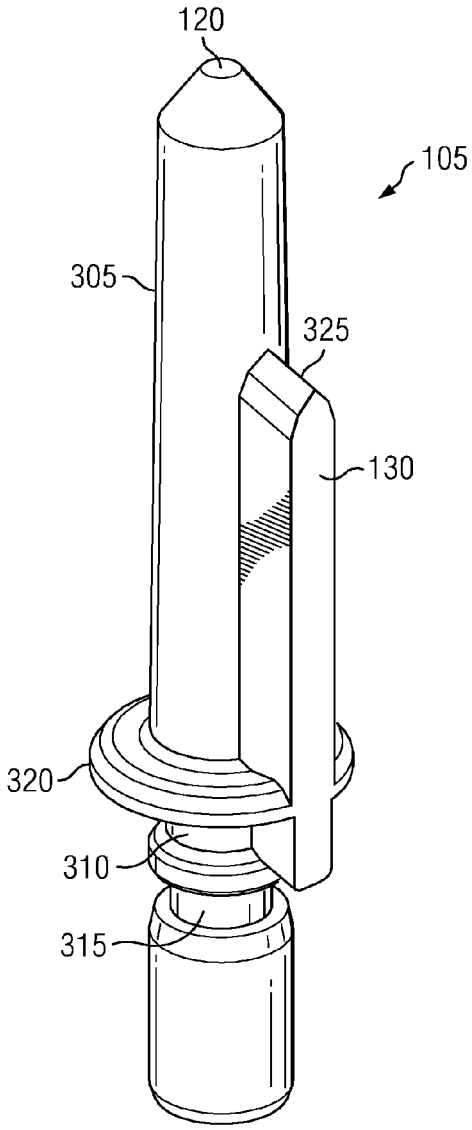
FIGS. 3A and 3B illustrates example manner of implementing the example key of FIGS. 1A-1F.

FIG. 3A illustrates an example manner of implementing the example key 105 of FIGS. 1A-1F. The example key 105 of FIGS. 3A and 3B includes a shaft 305 having the example upper annular guide surface or groove 310 and the example lower annular guide surface or groove 315. In some examples, the shaft 305 is 29.2 mm in length with a diameter of 2.46 mm. As described above, the example annular guide surfaces (i.e., grooves) 310 and 315 allow the snap heads 215 to hold key 105 in two positions relative to the key base 110. When the snap heads 215 are engaged in the lower groove 315, the key 105 is unset and can freely rotate. When the snap heads 215 are engaged in the upper groove 310, the position of the key 105 is set and the key 105 can no longer freely rotate.

Figure 3B:
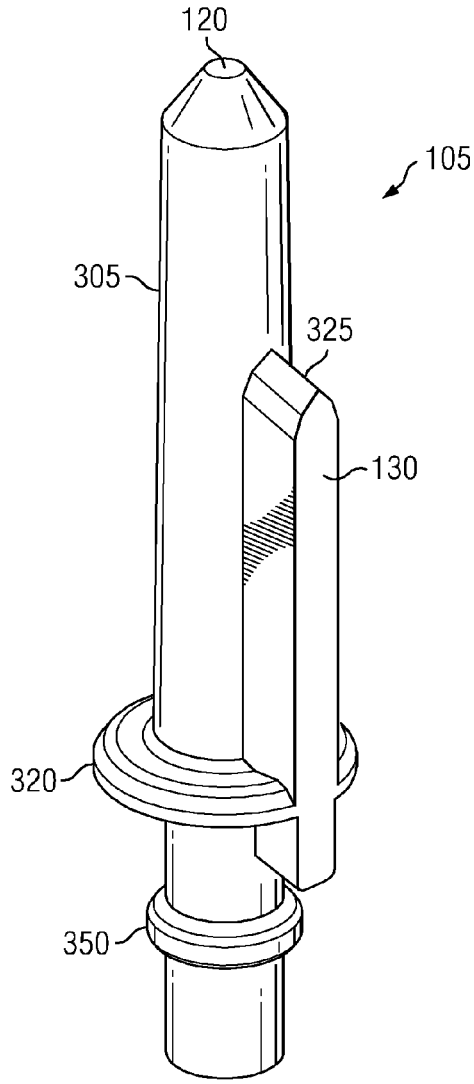

To prevent the key 105 from passing through the key base 110, the example key 105 of FIGS. 3A and 3B includes a stop or ring 320 having a diameter larger than the example cylindrical passageway 210. To allow the key 105 to rotate smoothly against the cam surface and/or edge 135, the end 325 of the example radial protrusion 130 that contacts the example surface 135 is tapered, rounded, angled and/or otherwise contoured to facilitate sliding and/or movement of the end 325 along the cam surface and/or edge 135. While the stop and/or ring 320 is depicted in FIGS. 3A and 3B, other example methods may be used to prevent the key 105 from passing through the key base 110. For example, a portion of the key shaft 305 may be tapered.

FIG. 3B illustrates another example manner of implementing the example key 105 of FIGS. 1A-1F. In the illustrated example of FIG. 3B, the annular ridge, stop and/or ring 350 extends around and/or protrudes from the shaft 305 to serve as a guide surface for holding the longitudinal position of the key 105. When the example fingers 205 (FIGS. 2A-2C) are positioned below the guide surface 350, the key 105 is held in a first longitudinal position that permits the key 105 to rotate in response to the cam surface 135. When the fingers 205 are positioned above the guide surface 350, the key 105 is held in a second longitudinal position where the protrusion(s) 130, 150 can engage the radial slots 145, 915 to fix, hold and/or set the rotational position of the key 105.

While not shown in FIG. 3B, the example key 105 of FIG. 3B may also include another annular protrusion, stop, ridge and/or ring near the bottom of the key 105 to prevent the key 105 from being inadvertently being removed from the key base 110.

In some examples, the key 105 is formed and/or molded with a low friction, high strength material to allow the key 105 spin freely in the key base 110 and to be easily rotated by the key receptacle cam surface 135, and to prevent the key 105, which is a small part, from twisting, buckling, breaking and/or bending if the wrong pluggable module is inserted. An example material that may be used to form the key 105 comprises a glass filled PC+PTFE, such as LNP Lubricomp DFL349. Because the example key 105 is more easily replaced, the example keys 105 described herein are designed to fail and/or break before the key base 110 and/or the key receptacle 115. The example key 105 is finished to have a polished finish and to be substantially free of flash.

Figure 4A:
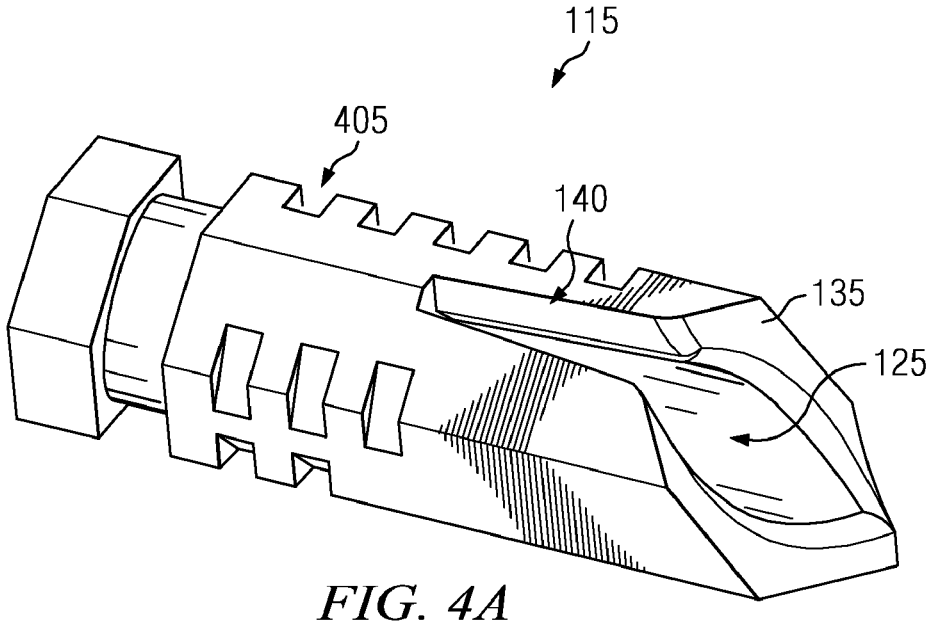
FIGS. 4A and 4B illustrate an example manner of implementing the example key receptacle of FIGS. 1A-1F.
Figure 4B:
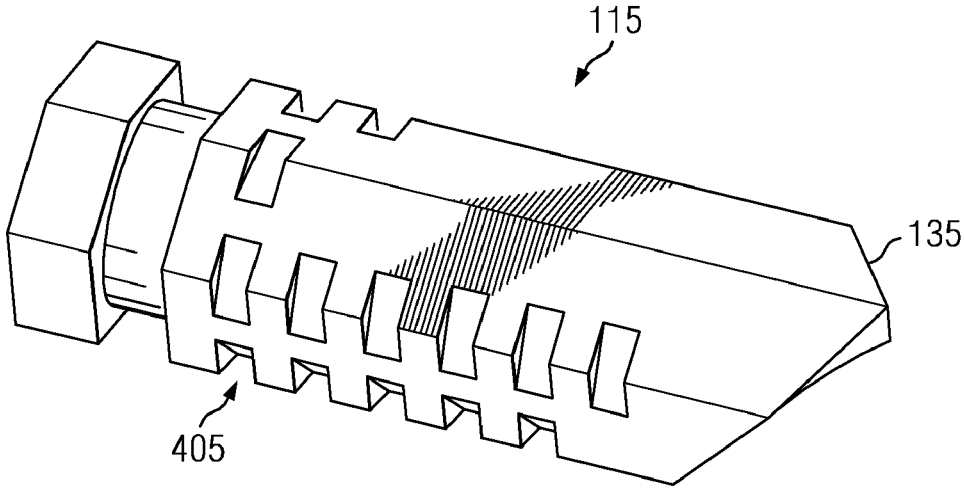

FIGS. 4A and 4B illustrate an example manner of implementing the example key receptacle 115 of FIGS. 1A-1F. Because some elements of the example key receptacle 115 of FIGS. 4A and 4B are identical to those discussed above in connection with FIGS. 1A-1F, the description of identical elements is not repeated here. Instead, identical elements are designated with identical reference numerals in FIGS. 1A-1F, 4A, and 4B, and the interested reader is referred back to the descriptions presented above in connection with FIGS. 1A-1F for a complete description of those identically numbered elements.

To correctly orient the example key receptacle 115 within a particular pluggable module, the body of the example key receptacle 115 has a different pattern of orientation slots (one of which is designated at reference numeral 405) on each side of the key receptacle 115. The key receptacle 115 can only be installed at a particular location within a pluggable module with a particular and/or intended orientation. The orientation of the key receptacle 115 within the pluggable module is determined by one or more patterns of orientation protrusions on an interior surface of the pluggable module with which the key receptacle 115 is in contact.

The slope of the example cam edge 135 is selected to rotate the key 105 without applying to the key 105 a force sufficient to prematurely and/or inadvertently set the position of the key 105. In some examples, the slope of the cam edge 135 is contoured or shaped so that 12 mm of linear travel of the key receptacle 115 corresponds to one revolution of the key 105. However, any other contour and/or shaped may be used instead.

In some examples, the key receptacle 115 is formed and/or molded from a flexible material, such as a PPE+PS (e.g., Xyron 644X), which has a relatively low coefficient of friction, and is finished to have a polished finish and to be substantially free of flash.

Figure 5A:
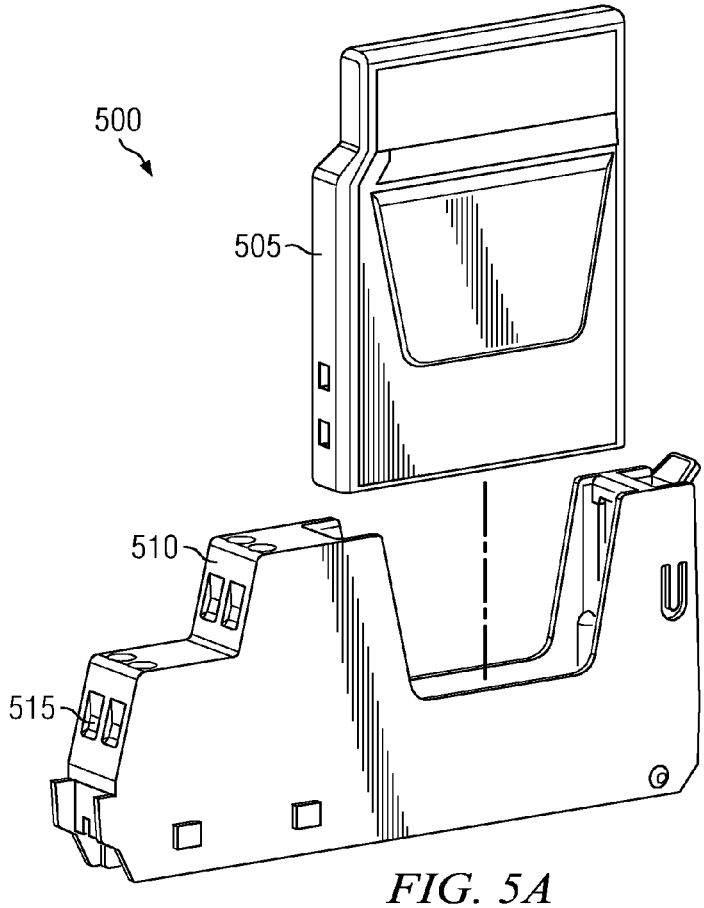
Figure 5B:
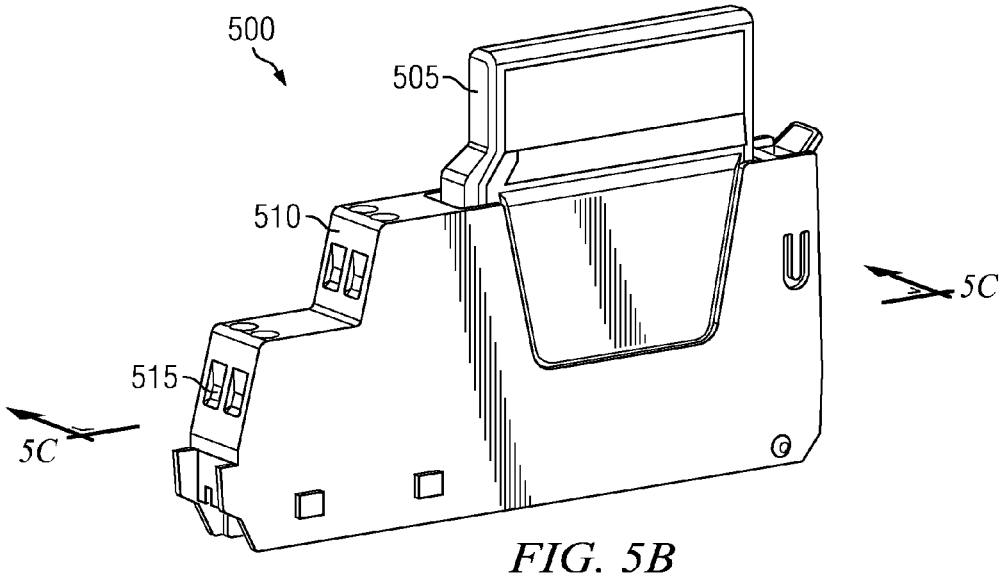

FIGS. 5A-5D illustrate an example apparatus 500 that may be keyed using the example key apparatus 100 of FIGS. 1A-1F. The example apparatus 500 of FIGS. 5A and 5B includes the pluggable module 505 and the pluggable-module socket 510 into which the pluggable module 505 may be inserted, as shown in FIG. 5B. The example pluggable-module socket 510 of FIGS. 5A-5D has any number and/or type(s) of contact(s), connector(s) and/or terminal(s), one of which is designated at reference numeral 515, to which wires and/or cables may be electrically and/or communicatively coupled to the example system 500. While the example connectors 515 of FIGS. 5A-5D do not include a key assembly 100, a connector 515 may include one or more key assemblies 100 to mechanically key the connector(s) 515.

FIG. 5C is a side cross-sectional view of the example system 500 of FIG. 5B taken along line 5C-5C when the pluggable module 505 is fully inserted into the pluggable-module socket 510. FIG. 5D is an enlarged view of a portion of the example side cross-sectional view of FIG. 5C in the vicinity of the key 105 and the key receptacle 115. As shown in FIGS. 5C and 5D, the example pluggable module 505 includes two key receptacles 115, and the example pluggable-module socket 510 includes two corresponding keys 105. However, any number of keys 105 and key receptacles 115 may be implemented. While not shown, the two key receptacles 115 may have the same or different orientations. Assuming the key receptacles 115 are hexagonally-shaped to provide six possible rotational orientations, the example pluggable-module socket 510 can be keyed to distinguish thirty-six different types of pluggable modules 505.

Because either the pluggable module 505 was used to key the pluggable-module socket 510 and/or because the pluggable module 505 is keyed the same as the pluggable-module socket 510, the example pluggable module 505 is fully insertable into the pluggable-module socket 510. As best shown in FIG. 5D, the position of the key 105 is set, the snap head 215 is engaged with the upper groove 310 of the key 105, and the tapered end portion 120 of the key 105 is in contact with the interior surface 520 of the key receptacle 115.

In the fully inserted position illustrated in FIGS. 5B-5D, electrical contacts 525 of the example pluggable module 505 are electrically coupled to electrical contacts 530 of the example pluggable-module socket 510 and, thus, to the example terminals 515. Via the example electrical contacts and/or terminals 515, 525 and 530, the example pluggable module 505 may be electrically and/or communicatively coupled to communication media and/or other devices via the communication media.

When the pluggable-module socket 510 has been keyed as shown in FIGS. 5C and 5D, a portion 540 of the key 105 extends beyond an outside edge and/or surface 550 of the pluggable-module socket 510. To reset the key 105 after the module 505 has been removed, the portion 540 of the key 105 extending beyond the outside edge and/or surface 550 may be pushed toward the pluggable-module socket 510 such that the snap head 215 engages the lower groove 315, thereby permitting the key 105 to again rotate freely. Additionally or alternatively, the position of the key 105 can be reset by pulling on the key 105 from within the pluggable-module socket 510.

While in the illustrated example of FIGS. 5A-5D, the key 105 was implemented in the pluggable-module socket 510 and the key receptacle 115 was implemented in the pluggable module 505, alternatively, the key receptacle 115 may be implemented in the pluggable-module socket 510 and the key 105 may be implemented in the pluggable module 505.

Figure 6:
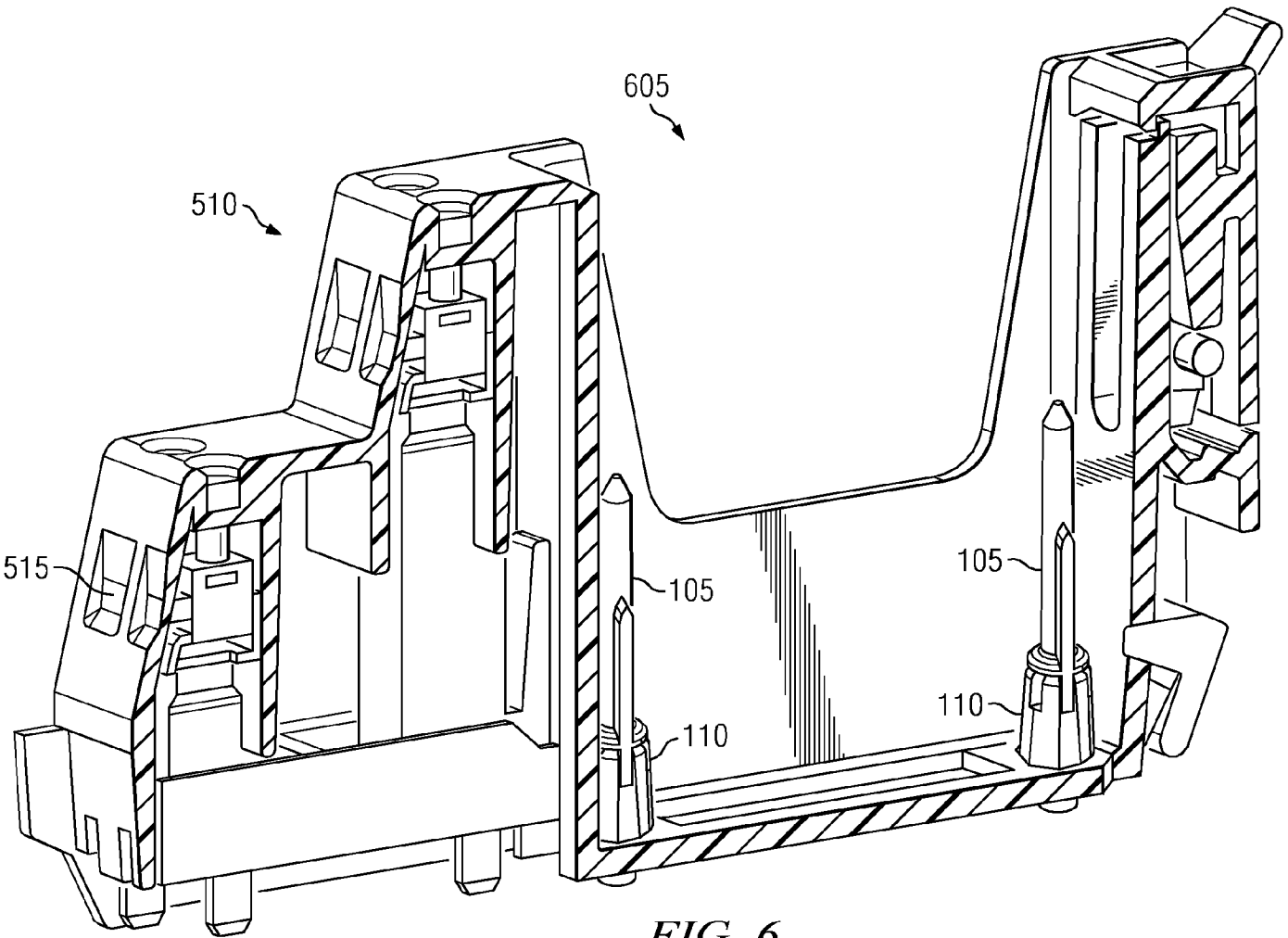
FIG. 6 is a partial cutaway view of an example manner of implementing the example pluggable-module socket of FIGS. 5A-5D.

FIG. 6 is a cutaway view illustrating an example manner of implementing the example pluggable-module socket 510 of FIGS. 5A-5D. As shown, the example pluggable-module socket 510 of FIGS. 5A-5D and 6 includes two sets of the example key 105 and the example key base 110. As illustrated in FIG. 6, the example pluggable-module socket 510 includes an opening 605 dimensioned to receive the example pluggable module 505.

Figure 7A:
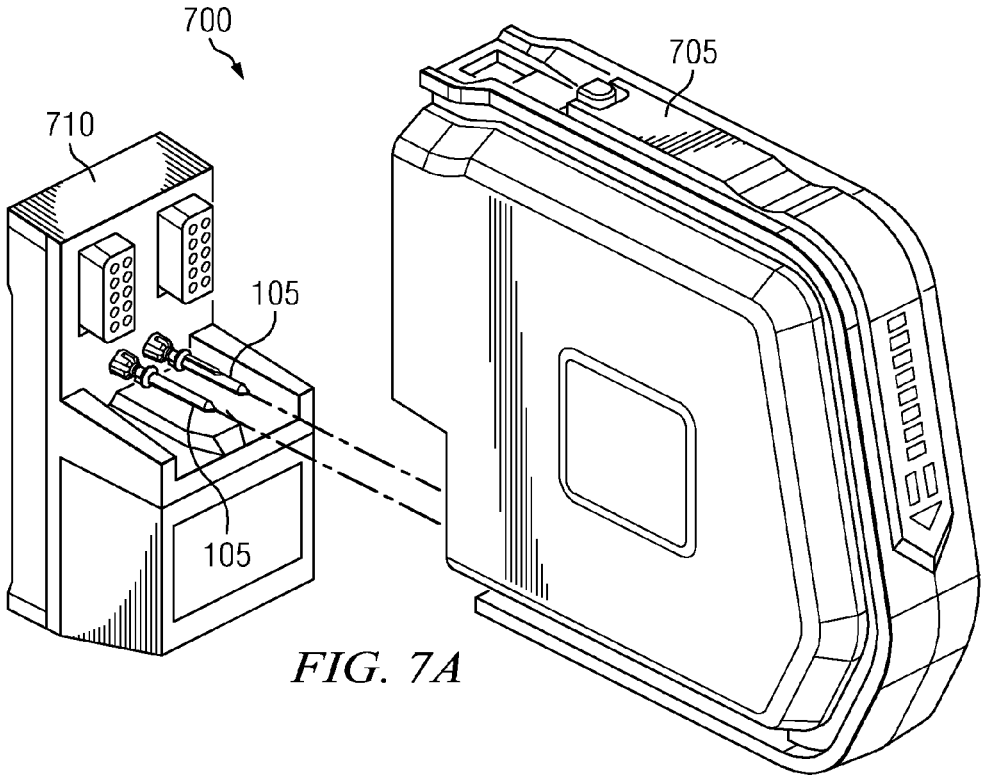
FIGS. 7A and 7B illustrate another example keying of a pluggable-module socket with the example key assembly of FIGS. 1A-1F, 2A-2C, 3, 4A and 4B.
Figure 7B:
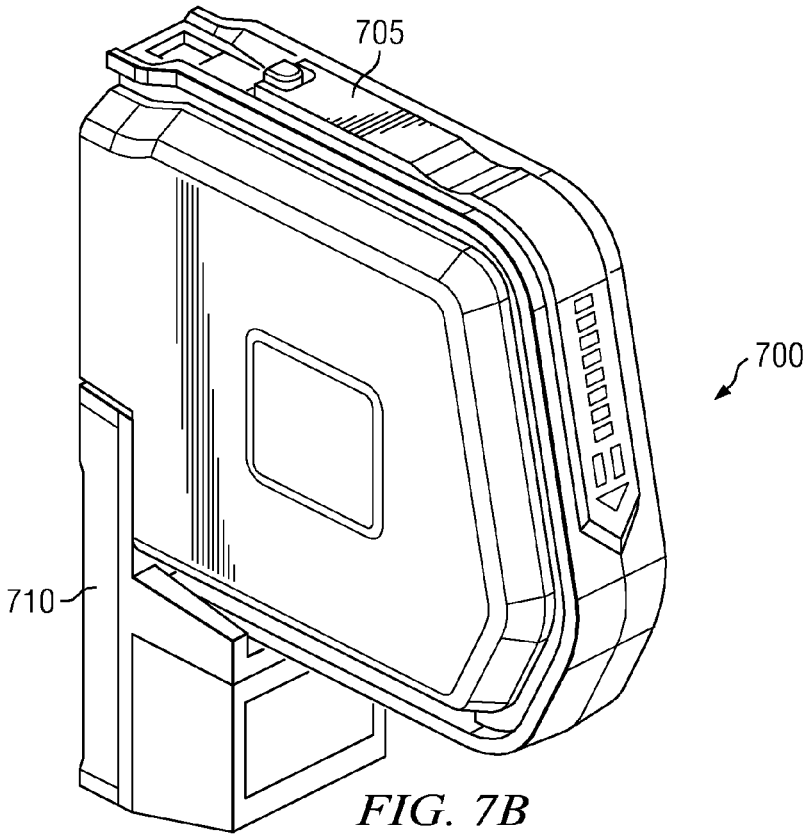

FIGS. 7A-7B illustrates another example apparatus 700 that may be keyed using the example key assembly 100 of FIGS. 1A-1F in a manner substantially similar to that described above in connection with FIGS. 5A-5D. The example apparatus 700 of FIGS. 7A and 7B includes a pluggable module 705 and a pluggable-module socket 710 to which the pluggable module 705 may be coupled, as shown in FIG. 7B. Like the illustrated example of FIGS. 5A-5D, the illustrated example of FIGS. 7A-7B implements two of the example key assemblies 110.

Figure 8:
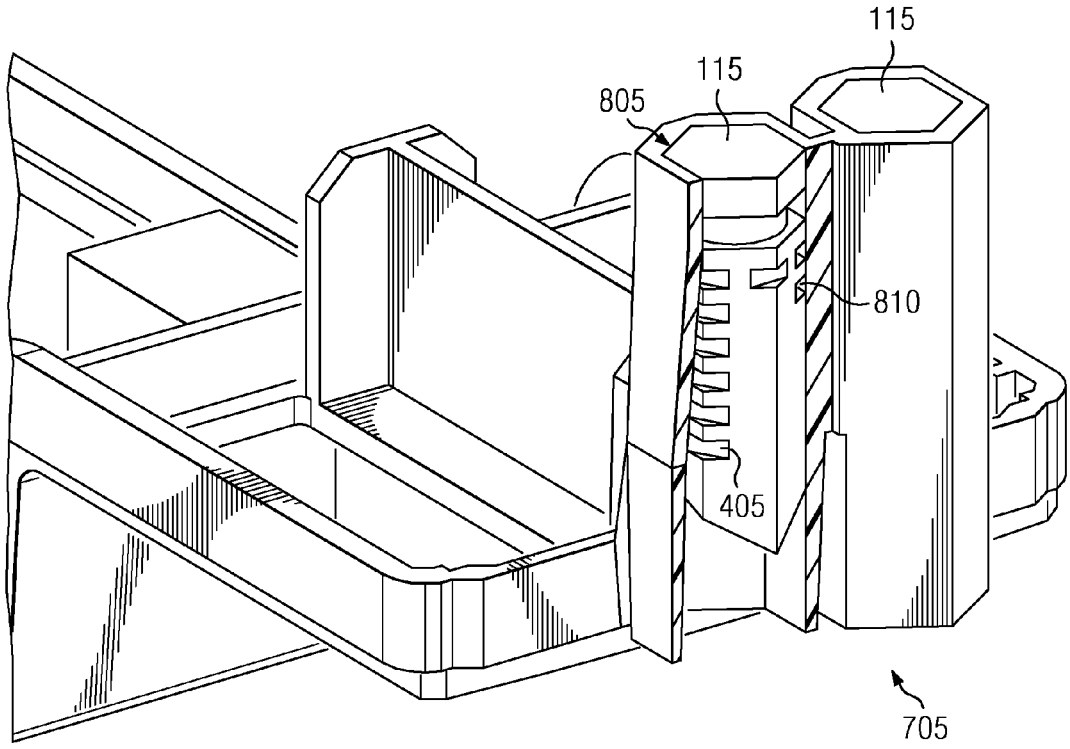
FIG. 8 is a partial cutaway view of an example manner of implementing the example pluggable module of FIGS. 7A-7B.

FIG. 8 is a partial cutaway view illustrating an example manner of implementing the example pluggable module 705 of FIGS. 7A and 7B. As illustrated in FIG. 8, each of the key receptacles 115 fits into a corresponding interior cavity and/or space of the pluggable module 705, one of which is designated at reference numeral 805. One or more surfaces of each of the example cavities and/or spaces 805 has a pattern of orientation protrusions (one of which is designated at reference numeral 810) that prevent a respective key receptacle 115 from being inserted and/or installed within the cavity and/or space 805 in other than an intended rotational orientation. When a key receptacle 115 is installed, it is rotated so that the side(s) of the key receptacle 115 that are to be against the surface of the cavity and/or space 805 have a corresponding, matching and/or mating pattern of the orientation protrusions 810. The key receptacles 115 may have the same or different rotational orientations depending on the type of pluggable module 115.

The example key receptacles 115 of FIGS. 5A-5D may be held in place within the example pluggable module 505 in a manner that is substantially similar to that shown in FIG. 8.

What is claimed is:

1. A key assembly, comprising:

a key having a shaft, a first radial protrusion extending from the shaft and an annular guide surface on the shaft; and a key base having a plurality of fingers defining a plurality of radial slots and an opening to receive at least a portion of the shaft, wherein at least one of the fingers is to engage the annular guide surface to enable the key to rotate to a set position, and wherein the first radial protrusion is to engage one of the slots to rotationally hold the key in a set position when the at least one of the fingers forced out of engagement with the annular guide surface.

2. A key assembly as defined in claim 1, wherein the key further comprises a second radial protrusion to engage a key receptacle to cause the key to rotate to the set position.

3. A key assembly as defined in claim 2, wherein the first and second radial protrusions are part of an elongated protrusion extending along a longitudinal axis of the shaft.

4. A key assembly as defined in claim 1, wherein the key further comprises a second radial protrusion to engage a second of the radial slots to rotationally hold the key in the set position when the at least one of the fingers is forced out of engagement with the annular guide surface.

5. A key assembly as defined in claim 1, wherein the annular guide surface comprises a first annular groove, and wherein the key further comprises a second annular groove spaced along the shaft from the first annular groove to receive the at least one of the fingers to longitudinally hold the key in the set position.

6. A key assembly as defined in claim 1, wherein the annular guide surface comprises at least one of a ring, an annular protrusion, or an annular stop, and wherein forcing the at least one of the fingers out of engagement with the annular guide surface comprises forcing the at least one of the fingers to an opposite side of the annular guide surface.

7. A key assembly as defined in claim 1, wherein the key further comprises a stop to prevent the key from moving along a longitudinal axis of the shaft toward the key base.

8. A key assembly as defined in claim 1, further comprising a key receptacle having a cam surface to engage a second radial protrusion of the key to cause the key to rotate to the set position.

9. A key assembly as defined in claim 8, wherein the second radial protrusion comprises a contoured end.

10. A key assembly as defined in claim 8, wherein the key receptacle comprises a slot to slidably engage the second radial protrusion.

11. A key assembly as defined in claim 8, wherein the key receptacle comprises a body shaped to maintain a rotational orientation of the key receptacle.

12. A key assembly as defined in claim 8, wherein the key receptacle is to apply a force to the key to force the at least one of the fingers out of engagement with the annular guide surface.

13. A key assembly as defined in claim 12, wherein the key receptacle further comprises an interior surface to apply the force to the key.

14. An assembly, comprising:

a first module having a key and a key base; and a second module having a first key receptacle to set a rotational position of the key corresponding to a rotational orientation of the first key receptacle when the second module is inserted into the first module, the rotational position of the key to remain set when the second module is removed from the first module and to prevent a third module having a second receptacle having a different rotational orientation from being inserted in the first module;

wherein the key comprises a shaft, a first radial protrusion extending from the shaft and an annular groove on the shaft, and wherein the key base comprises a plurality of fingers defining a plurality of radial slots and an opening to receive at least a portion of the shaft, wherein at least one of the fingers is to engage the annular groove to enable the key to rotate to a set position, and wherein the first radial protrusion is to engage one of the slots to rotationally hold the key in a set position when the at least one of the fingers forced out of engagement with the annular groove.

15. An assembly as defined in claim 14, wherein the key further comprises a second annular groove spaced along the shaft from the annular groove to receive the at least one of the fingers to longitudinally hold the key in the set position.

16. An assembly as defined in claim 14, wherein the key further comprises a second radial protrusion to engage a cam surface of the first key receptacle to rotate the key as the second module is inserted into the first module.

17. An assembly, comprising:

a first module having a key and a key base; and a second module having a first key receptacle to set a rotational position of the key corresponding to a rotational orientation of the first key receptacle when the second module is inserted into the first module, the rotational position of the key to remain set when the second module is removed from the first module and to prevent a third module having a second receptacle having a different rotational orientation from being inserted in the first module;

wherein the first key receptacle comprises:

a hexagonally-shaped body to maintain the rotational orientation of the first key receptacle; and a cam surface to engage a second radial protrusion of the key to cause the key to rotate to the set position.

18. An assembly as defined in claim 14, wherein the first key receptacle is to apply a force to the key to force the at least one of the fingers out of engagement with the annular groove to set the radial position of the key.

19. An assembly as defined in claim 18, wherein the first key receptacle comprises an interior surface to apply the force to the key.

20. An assembly as defined in claim 14, wherein the first module has a first electrical contact to electrically couple a wire to a second electrical contact, the second module has a third electrical contact, and the second and third electrical contacts are in electrical contact when the second module is inserted into the first module.

21. A key receptacle to mechanically set a rotational position of a key, comprising:

a body shaped to maintain a rotational orientation of the key receptacle;

a cam surface defined on an end of the body to rotate the key during an engagement of the key receptacle and the key; and a longitudinal slot corresponding to the rotational orientation of the key receptacle to slidably engage a protrusion of the key and to hold the rotational position of the key while the rotational position of the key is set.

22. A key receptacle as defined in claim 21, wherein the key receptacle is to apply a force to the key to engage a second radial protrusion of the key in one of a plurality of radial slots of a key base and to position a finger of the key base relative to a guide surface of the key to prevent the set rotational position of the key from changing.

23. A key receptacle as defined in claim 22, wherein the key receptacle further comprises an interior surface to apply the force to the key.

24. A key receptacle as defined in claim 21, wherein the body is hexagonally shaped.

25. A key receptacle as defined in claim 21, wherein the body comprises:

a first pattern of orientation slots on a first surface of the body; and a second pattern of orientation slots on a second surface of the body, the second pattern different from the first pattern, the key receptacle to be rotationally oriented within a pluggable module based on the first and second patterns of orientation slots.

* * * * *